United States Patent [19]

Jones

[11] 4,338,769

[45] Jul. 13, 1982

[54] OVEN REGULATOR FOR A SKIN PACKAGING MACHINE

[75] Inventor: Stephen H. Jones, LaFrance, S.C.

[73] Assignee: Nordson Corporation, Amherst, Ohio

[21] Appl. No.: 245,752

[22] Filed: Mar. 20, 1981

[51] Int. Cl.[3] ..... B65B 11/52

[52] U.S. Cl. ..... 53/509; 219/398; 219/492

[58] Field of Search ..... 53/509, 557; 219/395, 219/398, 492, 250, 257, 263, 459, 485

[56] References Cited

U.S. PATENT DOCUMENTS

| | | | |
|---|---|---|---|
| 3,050,611 | 8/1962 | Kamide | 219/492 X |
| 3,541,429 | 11/1970 | Martin | 219/492 X |
| 3,560,711 | 2/1971 | Manecke | 219/398 X |
| 3,621,200 | 11/1971 | Watts, Jr. | 53/509 |
| 3,666,921 | 5/1972 | Shevlin | 219/492 |
| 3,681,569 | 8/1972 | Schwarz | 219/492 |
| 3,745,739 | 7/1973 | Madsen et al. | 53/509 X |
| 4,233,498 | 11/1980 | Payne et al. | 219/492 X |
| 4,256,951 | 3/1981 | Payne et al. | 219/492 |

*Primary Examiner*—Horace M. Culver
*Attorney, Agent, or Firm*—Wood, Herron & Evans

[57] ABSTRACT

In a skin packaging machine, a method and apparatus for maintaining a film heating oven at a low temperature wherein during a very short repeating duty cycle, e.g., less than a minute, the power to the oven heaters is applied for a short period and is shut down for the remainder of the period through solid state relay switching.

8 Claims, 23 Drawing Figures

$t_{DC}$ = TIME OF DUTY CYCLE.
$t_{RB}$ = TIME TO RESET TIMER B TO RESTART.
$t_H$ = TIME TIMER B IS COMPLETE, BEFORE END OF DUTY CYCLE, OVEN IS ON.
$t_{LH}$ = TIME "RESIDUAL" HEAT FUNCTION IS PERMITTED TO OPERATE.

$t_{DC}$ = TIME OF DUTY CYCLE.
$t_{RB}$ = TIME TO RESET TIMER B TO RESTART.
$t_H$ = TIME TIMER B IS COMPLETE, BEFORE END OF DUTY CYCLE, OVEN IS ON.
$t_{LH}$ = TIME "RESIDUAL" HEAT FUNCTION IS PERMITTED TO OPERATE.

SSR'S WILL TURN ON UP TO 5° OF ZERO CROSSOVER POINT WITH RESISTIVE LOAD. THEREFOR, CRITICAL TIMES ARE SHOWN AS FOLLOWS

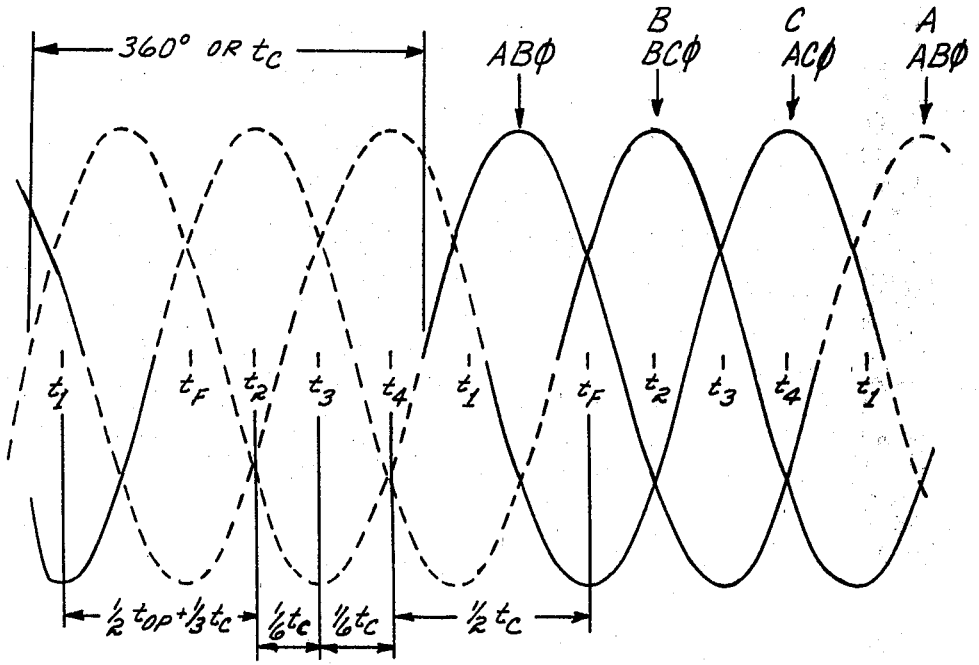

$t_1$ - SENSE A-BØ OPTOISOLATOR INPUT.
$t_2$ - TEST OPTOISOLATORS FOR PROPER 2SSR/5SSR STATES.
$t_3$ - TEST OPTOISOLATORS FOR PROPER 1SSR/4SSR STATES. SET 1SSR/4SSR STATES FOR NEXT CYCLE.
$t_4$ - TEST OPTOISOLATORS FOR PROPER 3SSR/6SSR STATES. SET 2, 3, 5 & 6SSR STATES.
$t_F$ - IF ENCOUNTERED BEFORE FINDING AN A-BØ PULSE ($t_1$), CONTROLLER ASSUMES ABØ LOST, EFFECTS A TOTAL SHUTDOWN.

Fig. 8

OVEN REGULATOR FOR A SKIN PACKAGING MACHINE

This invention relates to a skin packaging machine, and more particularly, the invention is directed to the control system for the oven of such a machine which heats the film which is applied to the product.

A skin pack package consists of a product mounted on corrugated board or paperboard and enclosed by a film of thermoplastic material.

The apparatus for making a skin pack package includes a horizontal base including a horizontal perforate plate and a source of vacuum pulling downward through the plate, a supply roll of film, a frame through which the film passes, the frame normally overlying the perforate plate and an oven overlying the frame. In operation, the film is disposed in the frame and a product positioned on the paperboard is placed on the perforate plate over the source of vacuum. Heat is applied to the film within the frame to raise its temperature to 130° to 200° F. causing it to become soft and to begin to droop. The frame is then lowered onto the product and the paperboard substrate while vacuum is applied beneath the substrate. The vacuum pulls the film tightly down upon the substrate to which it adheres and snugly draws the product down onto the substrate and encloses it within the film.

This apparatus generally has been known for many years. The problem, to which the present invention is addressed, is that during the portion of the operating cycle wherein the completed package is removed, a new substrate is placed on the plate and a fresh supply of film is drawn into the frame and it is desired to keep heat away from the film so that the fresh film does not become overheated and degrade. It is normally desired to keep the film unheated for 15 to 30 seconds while other operations are taking place.

One solution to the problem has been to provide shutters in the oven, the shutters closing off the direct application of heat to the film. While the shuttered oven has performed reasonably well, it suffers from two disadvantages. First, there is a tendency of the radiant heat through the shutters to degrade the film prior to its application to the product and substrate and second, the apparatus is somewhat inefficient in that there is, during that portion of the cycle, an unnecessary dissipation of heat to atmosphere.

Another approach to the problem has been to deenergize the oven during the no-heat required portion of the cycle. The drawback with that system is that there is a finite time, at least five to ten seconds, required to heat the oven to the temperature necessary to soften the film. That finite time reduces the cycle time for the operation thereby slowing down production.

Therefore, an objective in the art of skin packing has been to reduce substantially the energy applied to the oven during the no-heat required portion of the cycle while maintaining a certain amount of residual or low heat in the oven so as to minimize or substantially eliminate that portion of the cycle required to raise the temperature of the oven to the temperature necessary to soften the film.

One approach to maintaining a residual heat has been to reduce the voltage applied to the oven to a low voltage sufficient only to maintain the oven at a high enough temperature that there is no significant loss of cycle time to bring the oven up to the desired temperature for softening the film.

There are some disadvantages with this approach. If a transformer is employed to reduce the applied voltage to the oven heaters, then there is no flexibility as to the level of energy applied. On the other hand, if a variable transformer such as a variac is employed, then the expense of providing a reduced but adjustable low voltage is prohibitive.

An objective of the present invention has been to provide skin pack packaging apparatus wherein a variable control is employed to reduce the heat during the no-heat required period in order to avoid degrading the film, the control system being inexpensive compared to other comparable methods of achieving generally the same result.

The objective of the invention is attained by two forms of the invention. One form of the invention, which is quite inexpensive, is suitable for low power requirements as, for example, those requiring an input of approximately nine killowatts. Such a system is suitable for applying film to a board of approximately 18×24 inches.

A larger board to which the product is applied as, for example, 30×36 inches, requires a higher power input as, for example, twenty-five killowatts, and requires a somewhat different but nevertheless effective system for applying a low heat during one portion of the cycle and a high heat during the other portion of the cycle.

Both the low power and high power ovens employ the same generic concept for energizing the oven with a low heat during the no-heat required portion of the cycle. In both systems, within a very small increment of time, preferably less than a second which will be referred to as the "duty cycle," the power to the heaters is turned on and off. The amount of heat applied to the heaters is determined by the ratio of "ON time" to "OFF time."

Through the use of solid state relays (SSR's) to switch the current to the oven heater elements on and off within very short intervals of time, and through the use of a control system which can vary the ratio of "ON time" to "OFF time," the power to system during the no-heat required portion of the cycle can be kept quite low, but also can be varied through a manual or operator control so as to adjust the system to varying types and thicknesses of films, ambient temperatures and the like for maximum efficiency and high production.

In one system, the objective of the invention is attained by providing an electronic timer providing a three-quarter second duty cycle and within that duty cycle providing a variable time during which power is not applied to the heaters, power being applied during the remainder of the cycle.

In the alternative system, the power is controlled in terms of units of alternating current cycles. Preferably, one complete alternating current cycle is the smallest unit of time employed by the system. If during each duty cycle the power applied to the heaters remains on for one complete ac cycle, then the ratio of ON to OFF time can be varied by programming the systems to deenergize the power to the heaters for one or more ac cycles. For example, if the power is to be reduced to fifty percent of full power, the ON time would be one cycle and the OFF time would be one cycle. A reduction to twenty-five percent would require an ON time of one cycle and an OFF time of three cycles. A reduction to thirty percent would require, in one hundred cycles, an "ON" time of one cycle with an "OFF" time of two cycles until thirty "ON" cycles had been operated. This control can be attained by employing solid state relays and a microcomputer for turning the relays on and off. The microcomputer is partially controlled by a manually-operable potentiometer which determines the ratio of cycles of "ON" to cycles of "OFF" time.

Another feature of the invention is to provide for switching to an "idle" mode which deenergizes the heaters after the system has been on a low heat mode for a predetermined period of time as, for example, approximately one minute.

Still another feature of the invention is to employ, with the circuits for the oven heaters, an instant "ON" heater wherein each heater consists of a quartz tube surrounded by a helical wound ribbon of nichrome wire as disclosed, for example, in U.S. Pat. No. 3,621,200.

Another feature of the invention is to provide a fan blowing air under the film during the noheat required period so that the temperature of the oven can be maintained as high as possible for fast cycling time but without degrading the film by too great an exposure of heat to the film during the no-heat required period.

The foregoing objectives and features of the invention will become more readily apparent from the following detailed description taken in conjunction with the accompanying drawings in which:

FIG. 7 is a single-phase curve illustrating the duty cycle of the invention; and FIG. 8 is a three-phase curve illustrating the operation of the invention.

Figure 1:
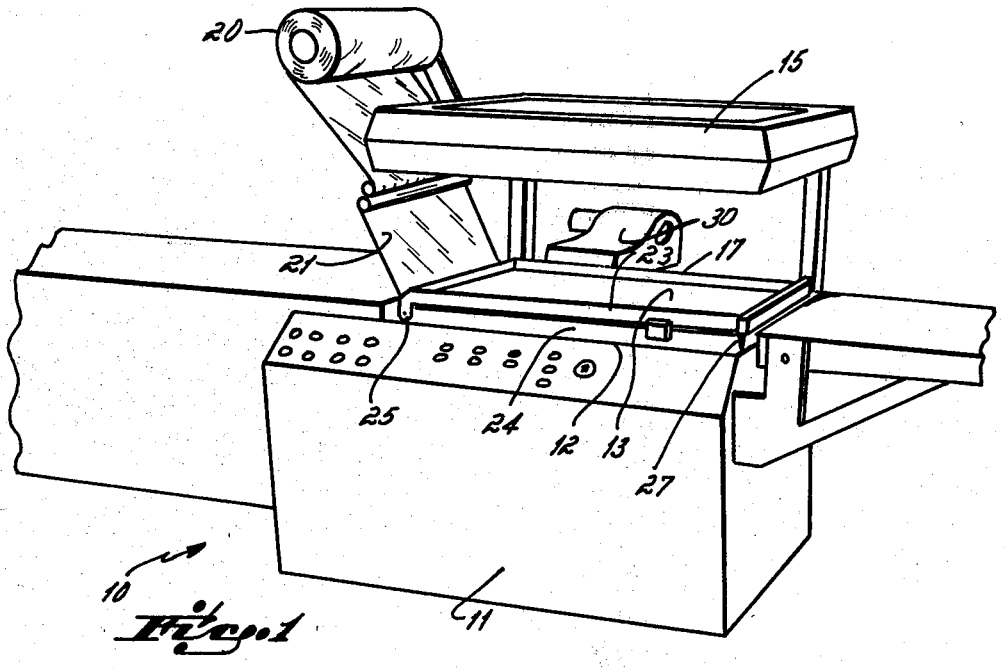
FIG. 1 is a perspective view of a skin packaging apparatus.

As shown in FIG. 1, the packaging apparatus indicated at 10 includes a base 11 presenting a horizontal surface 12 to which vacuum is applied through a perforated surface 13. An oven 15 overlies the perforated surface 13, the oven containing heaters of the type disclosed in U.S. Pat. No. 3,621,200. A rectangular frame 17 is disposed between the vacuum surface 12 and the oven 15 and is provided with a mechanism, not shown but located within the base, for raising and lowering the frame between an upper position adjacent the oven and a lower position adjacent the surface 12.

A supply roll 20 of film 21 is mounted adjacent the oven. The film is adapted to pass between upper jaw 23 and lower jaw 24 of the frame 7. The jaws are hinged at 25 so that they may be opened in order to pull a new supply of film into the frame.

A cutter 27 is provided adjacent the end of the frame remote from the hinge 25 for shearing the film between a finished skin pack package and the fresh film from the supply roll.

Preferably, a fan 30 is provided to blow cooling air across the film during the no-heat required period to permit the oven temperature to remain as hot as possible so as to minimize the time required to raise the temperature to the level required to plasticize the film.

In the operation of the apparatus, as thus far described, a substrate of corrugated board or paperboard is placed upon the perforated plate 13. A frame 17 with fresh film in it is positioned in its upper position between the oven 15 and the perforated plate 13.

The heat of the oven is applied to the film until it is "ready." In the "ready" state it has become soft and tends to physically droop below the frame. Thereupon, the frame is lowered to its lowermost position in which the film drapes around the object and the substrate which supports the object. A vacuum applied to the substrate pulls the soft film down upon the substrate whose surface may be treated to adhesively secure the film to the substrate while snugly drawing the product down upon the substrate. This concludes the heating portion of the cycle. At this point, energy to the oven is greatly reduced to a level which will not degrade a fresh film drawn into the frame even though the fresh film will underly the oven for a long period of time—for example, thirty seconds. The vacuum turbine is switched off. The jaws of the frame open up. The substrate with the object encased in the plastic film is slid toward the right as viewed in FIG. 1. In moving the substrate toward the right, a fresh supply of film 21 is pulled between the jaws 23 and 24 of the frame 17. When the substrate is moved completely from beneath the frame, jaws 23 and 24 close and the knife 27 is reciprocated to sever the film from the skin pack package and the fresh film supply.

The frame 17 is then raised to a point underneath the oven and a new substrate with product mounted on it is positioned on the perforated plate. When these operations have taken place, the oven then begins to heat the plastic film to soften it for the next skin pack package.

Figure 2:
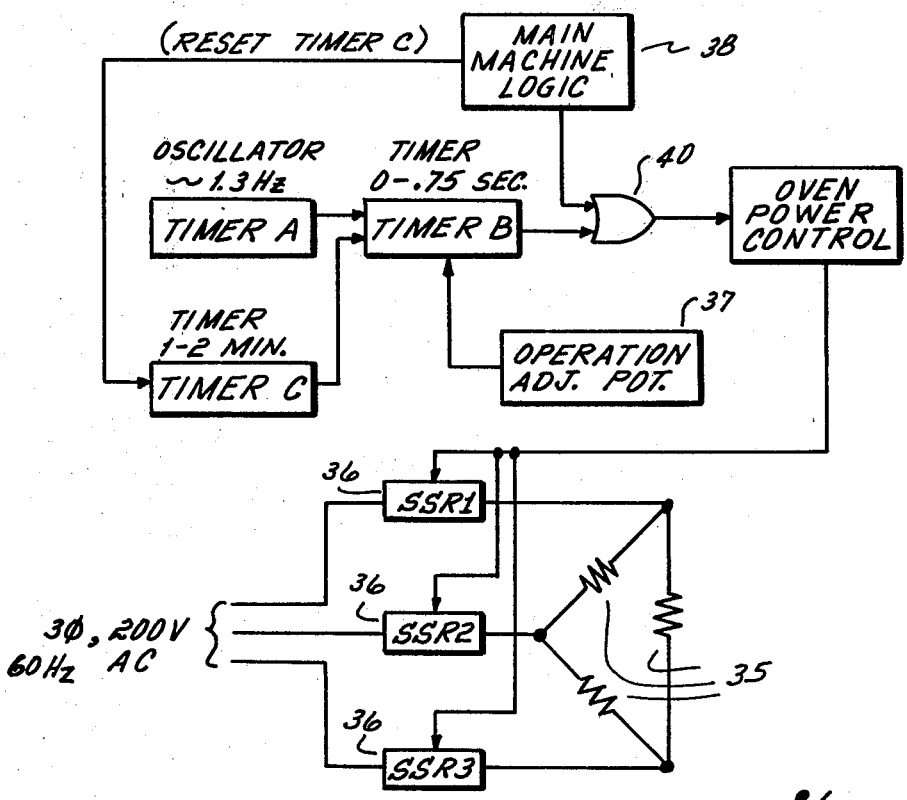
FIG. 2 is a block diagram of one embodiment of the invention for controlling the duty cycle of the oven heaters in the apparatus.

One circuit for operating the oven is diagrammatically illustrated in FIG. 2.

There, the oven heaters 35 are connected in delta configuration to the power supply which in the preferred embodiment is a three-phase 200 to 240 volts 60 hertz supply. The power supply is connected to the heaters 35 through three series solid state relays 36.

The function of the remainder of the circuit is to switch the solid state relays 36 on and off during a very short duty cycle as, for example, three-quarters of a second, and to be able to vary the ratio of "ON" time to "OFF" time so as to vary the level of energy which is put into the oven heaters. To that end, the circuit employs an A timer which is a free-running oscillator oscillating at approximately 1.3 hertz. The timer A is connected to a timer B which produces a pulse which may be from 0 to $\frac{3}{4}$ second. The length of the pulse is varied by a manually operable potentiometer circuit 37.

A timer C is connected to the main machine logic indicated at 38 and has an output connected to timer B. Timer C is set for about one or two minutes and is designed to prevent timer B from applying power to the oven after the oven has been on a low energy input for a predetermined period of time as, for example, a minute and a half. That length of time is substantially longer than would normally be required for the time required before another package cycle. The expiration of that length of time would indicate that there is no more packaging activity and that the oven should be shut completely down.

Figure 3:
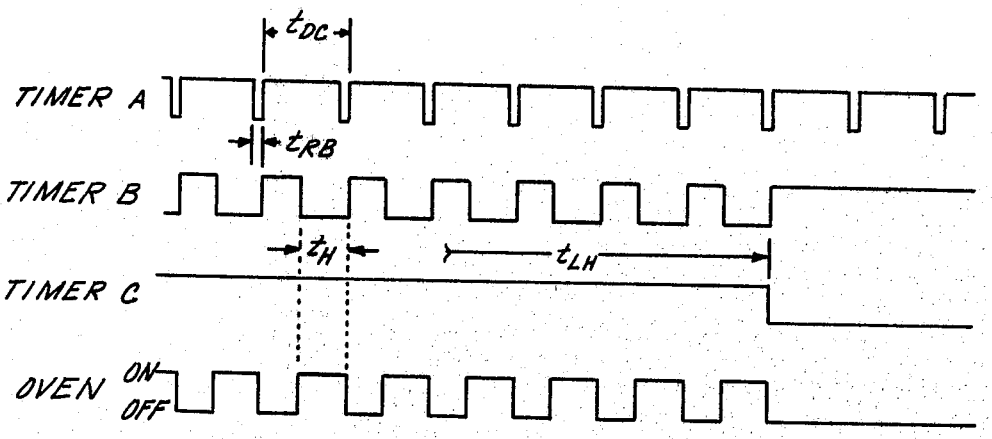
FIG. 3 is a time diagram illustrating the operation of the invention.

The operation of the timers is indicated in FIG. 3. It can be seen that timer A provides the main duty cycle which controls and resets timer B during the interval $t_{RB}$. Timer B controls the oven through the OR-gate 40.

$t_H$ is the time left in the duty cycle after timer B has timed out. During the time $t_H$, in each duty cycle, the oven is on. As the length of time for the timer B to time out is increased, through the manipulation of the potentiometer 37, the energy to the ovens is decreased. The energy to the oven will stay low until either the machine logic turns the oven onto full power through the OR-gate 40 or, alternatively, until the timer C times out at the end of $t_{LH}$. At that point, timer C will shut down timer B so that no more signal from timer B can be applied to the OR-gate 40 and hence the power to the oven will be completely turned off until the machine is recycled.

Alternative Embodiment

In the alternative embodiment of the invention, the duty cycle for the lower power input to the oven heaters will be effected generally as follows: the power to the heaters will be turned on, through solid state relays, for one full alternating current cycle of the three-phase power supply. The solid state relays will be controlled to turn off the power to the heaters for one or more full alternating current cycles. A number of cycles during which no power is applied to the heaters determines the level of energy applied to the heaters. If the ratio of ON to OFF is one-to-one, then the energy to the heaters is fifty percent of full power. If the heaters are turned off for two cycles, then the power has been reduced to one-third as compared to full power, etc.

Figure 4:
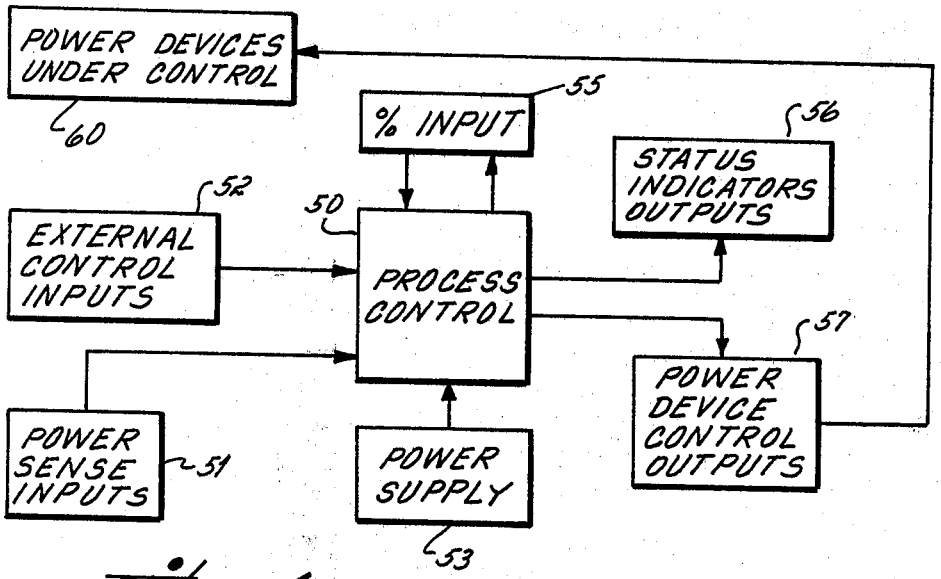
FIG. 4 is a block diagram of an alternative form of the invention.

The circuit for effecting the variable power input to the oven is diagrammatically illustrated in FIG. 4 in block diagram form. The circuit includes a process control 50 which is a microcomputer which runs on a fixed clock by itself and thus has its own timing functions built in.

The process control reads power sense inputs indicated at 51. The power sense inputs monitor the status of the solid state relays every cycle. All three of the two hundred to two hundred forty volt inputs are monitored by the power sense inputs. These straight parallel inputs to the process control are read by the process control as required by the process control.

As indicated at 52, the process control also reads external control inputs from the machine logic. These inputs are basically two, namely, the full power to the heaters and the low power reset input. The full input is the machine logic input command to put the oven at full power continuously. The reset low power input is that function whereby the operator presses the reset button on the machine and restarts the low power after it has been stopped in an idling mode. Block 53 is a standard low-voltage dc power supply for the process controller.

Block 55 is an operator adjustment input which determines what percentage of full power will be applied to the heaters during the lower power portion of the cycle of operations. It includes a potentiometer operable by the operator of the machine and an analog-to-digital converter to provide a digital input to the process control.

Block 56 represents status indicators. These are strictly outputs which indicate the mode of operation that the apparatus is in. They indicate whether the oven is in a low heat or full heat mode; they indicate any necessary fault conditions; and they indicate whether there is any problem with any one of the six banks of heaters in the oven.

Figure 5:
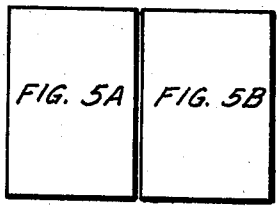
FIG. 5 is a circuit diagram of the alternative form of the invention.
Figure 5A:
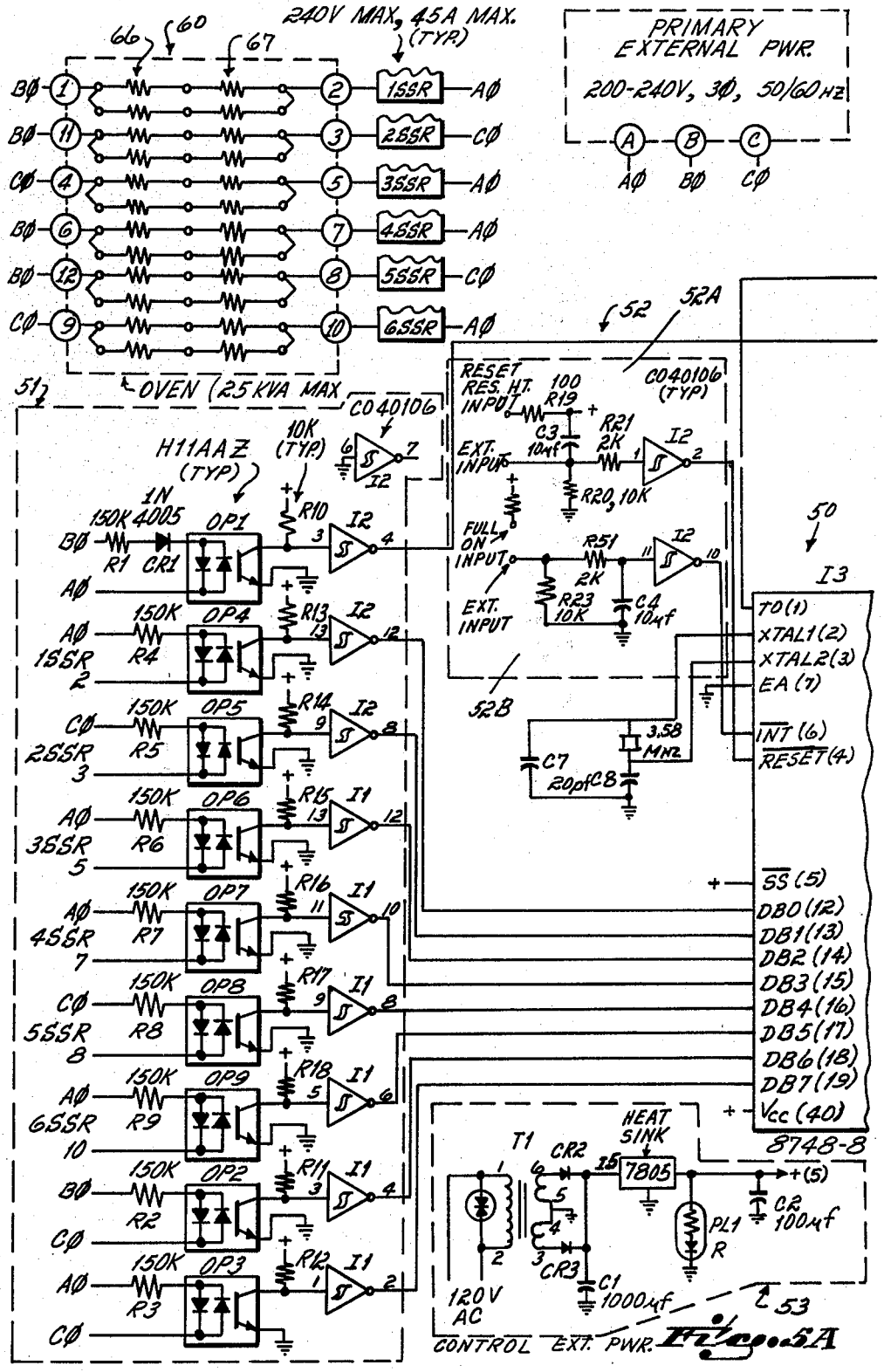
Figure 5B:
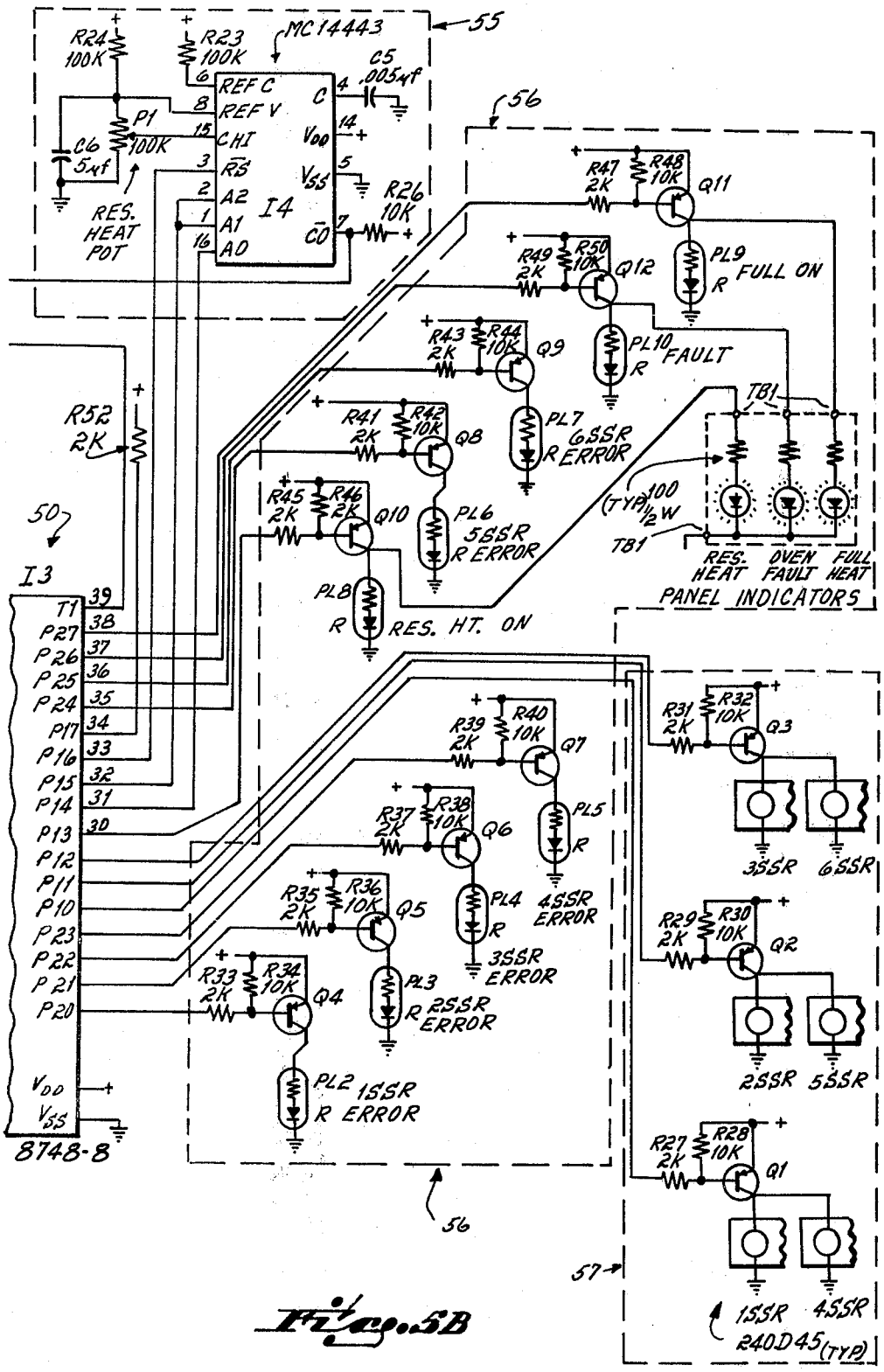

Block 57 represents the group of six solid state relays which control the six heaters which are connected in two parallel delta configurations, as indicated at block 60 (FIGS. 4 and 5).

In the operation of the system of FIG. 4, when power is applied to the oven, the power supply 53 will supply power to the process control 50. Power to the oven heaters, block 60, is supplied through the solid state relays, block 57, associated with the heaters, the solid state relays being under the control of the process control 50.

The operator sets the level of energy applied to the heaters during the no-heat required portion of the cycle of operations by manipulating the potentiometer at 55.

Referring to FIG. 1, a substrate is placed on the perforate support forming part of the base 11 with the articles to be skin packed to that substrate placed upon it. The frame, indicated at 17, has been raised to a position adjacent the oven and carries the fresh film to be applied to the substrate. The external controls, at 52, cause the solid state relays to apply full heat to the oven heaters at 60. When the film becomes "droopy" or ready, the frame is lowered to a position overlying the substrate and vacuum is applied to draw the film down tightly against the substrate and the article on the substrate. Vacuum is applied to the perforate sheet upon which the substrate rests to pull the film down upon the substrate.

Thereafter, the turbine applying the vacuum is turned off and the oven is switched to the no-power required mode.

During the no-power required mode of operation, the microcomputer or process control 50 applies full power to the heaters for one cycle only, through the operation of the solid state relays, and thereafter applies no power to the heaters for one or more cycles, as determined by the setting on the input 55.

This duty cycle of power applied for one cycle and power removed for a plurality of cycles is repeated during the period of time that the oven is in the no-heat required mode. During this period, on the machine, air is blown through the perforate plate supporting the substrate to loosen the substrate from the plate. The film clamp or frame 17 opens. The package is ejected toward the right as viewed in FIG. 1, pulling with it a new supply of film into the frame 17. The frame then closes upon the new supply of film and a cut-off knife slits the film between the freshly made package and the frame.

The frame then rises and pauses for a short period of time to let all automatic circuits return to their initial or OFF state. At this time, a new substrate is placed on the perforate plate 13 and the oven shifts to a full On power mode.

If for some reason it was not possible to have the elements of the machine in a position ready for the full power mode, and the machine had been in a low power mode for a substantial period of time as, for example, a minute and eight seconds, the control circuit would automatically shift the oven heaters to "idle" during which the power is turned completely off the heaters.

The circuit and control system for operating the apparatus in the manner just described is more completely disclosed in FIGS. 5–8.

Referring to FIG. 5, the drawing can be blocked out in a simple manner. In the upper left-hand corner of FIG. 5 are the actual oven-heating elements 60 which are under control by this device. In the more or less center top of the drawing is a section 51 where the external three-phase power is brought into the system. All the devices located to the left center, indicated at 51, are high voltage power sensors that bring information into the central processor. There are two external inputs 52 shown between the center and the left of the drawing, one of which, 52A, is an operator input, namely, the residual or low heat input, and the other, 52B, which is a machine control input, namely, the full ON input. The center section 50 is the processor controller itself where all of the data that is input is manipulated and modified to control the outputs which in turn control the heating elements. The section 55 at the top right center of the drawing which is dominated by integrated circuit I4 is the operator set point input conversion system for the process controller. All of the devices 56, 57 to the right are output control devices, and the section at the bottom center 53 is the controller's own power supply showing the external control power connection.

Starting with the power input sensors 51 at the far left, these sensors are optical isolators which can sense the power waveform in either direction by transferring the information of the power waveform by optoelectrics into the logic circuit. That is what is being done by OP-1, OP-4, OP-5, OP-6, etc. These devices are protected from overcurrent by the 150,000 ohm resistors at the head end which are R-1, R-4, R-5, etc. the diode CR-1 which is used on OP-1 limits it to strictly being able to read only one-half of the waveform, and in this manner the controller can always key in at the beginning of a waveform instead of accidentally keying in halfway through a waveform.

The AB-phase opto-input which is OP-1 will always only be able to read at one point in the ac waveform. The ac forms which are being read by these input devices are either the A-phase to B-phase, A-phase to C-phase, B-phase to C-phase power voltages or the voltages across any one of the six solid state relays (SSR). Consequently, there are nine power input points. They read the voltage across the solid state relays in a reverse mode; that is to say, when they sense there is a signal, it means that the solid state relay is not conducting. When there is no signal the solid state relay is essentially a short which means that it is turned on. So these devices, by looking at the opposite state, can determine whether or not the solid state relays are actually performing their function when required. Moving into the logic section of the inputs, the optical isolators (OP-1-9) are only able to give a logical zero by pulling their output into ground and there being fed into Schmitt triggers which are CMOS devices which must have either a logical 1 or logical 0 to have significant results displayed in their outputs.

To attain the logical 1 condition when the optoisolator is not signalling, the 10,000 ohm resistors provide that logical 1 condition, and these resistors are such as R-10, R-13, R-14, etc. The Schmitt triggers which are all located in I-1 and I-2 are a logic gate that will turn on upon the input to that gate reaching a specified voltage and will not turn off until it drops significantly below that specified voltage. This voltage is specified by the manufacturer of the device. The idea of the Schmitt trigger is that it has what we call a defined hysteresis for turning on and turning off. It has a greater input level switching span than the standard logic gate. These are inverters in addition, which means that when you have a logical zero applied at the input, you have a logical 1 on the output. This is really inconsequential except that that has to be taken into account when the inputs are tested by the process controller.

Moving over to the external inputs 52, the residual or low heat reset input 52A has a circuit design on it that will not only prevent misfires from external noise, but also forces the process controller to reset itself when the power is turned on. The machine that this controller is located in also has one of the contacts of its own master reset button tied across this input so that anytime anyone presses the reset button on the machine, they will cause the controller to restart in its reset mode. The full ON input 52B only has filtering to prevent miscellaneous electrical noise from misfiring the input. The process controller 50 is a single chip microcomputer. It is running at 3.58 megahertz, which is dictated by the X-1 crystal in the upper left corner of it; it is an Intel 8747-8 and it is preferably programmed with a program that is defined on the accompanying flow charts in order for this whole system to operate.

Up in the top center right is the conversion area which is operator controlled to determine the energy input to the heaters during the period of low heat. This conversion system is a Motorola analog-to-digital conversion subsystem. It cannot do an entire analog-to-digital conversion on its own. The timing and counting functions must be provided from the central processor to accommodate this function. The potentiometer R-1 is the operator's set point adjustment where he can select from 0 to 50% of maximum heat for the low heat to the heaters. That potentiometer is located on the front of the controller where an operator can usually get to it. The capacitor C-6 is only used to maintain a relatively steady voltage across P-1 while the conversion is taking place.

The other devices R-24, R-25 and C-5 are used by the Motorola subsystem to make it operate. R-26, the 10,000 ohm resistor, is used in the same manner as R-10 is used over on I-2 on the left, and that is to pull up the input to the central processor from the Motorola system because the Motorola system can only switch to a logical 0.

Moving over to the outputs 56 and 57, starting at the bottom and working up, there are six indicator lights labeled as 1-SSR error, 2-SSR error, 3-SSR error, 4-SSr error, and so on to 6-SSR error. Those indicator lights are driven by pnp transistors. The pnp transistor base current is driven by the central processor, and it is limited by resistors R-33, R-35, R-37, R-39, R-41 and R-43. When the processor is outputting a logical 1, the 10,000 ohm resistors shown there, R-34 to R-44, prevent the pnp transistors from turning on. When the processor outputs a logical 0, the transistors are turned on by the base current being sunk through the 2,000 ohm resistors. A residual or low heat-on indicator, a fault indicator and the full-on indicators are also in the upper section 56. In the center of the drawing, in section 57, are the solid state relay control transistors Q-1–Q-3. The gating function is the same except instead of driving indicator lights, the transistors Q-1 to Q-3 are driving the input sides of the solid state relays 1-SSR to 6-SSR. Whenever those transistors conduct, the solid state relay power circuits will appear as a dead short in the power system indicated at 60 as 1-SSR to 6-SSR.

The heater rods themselves are shown in the oven as two elements 66 and 67 in series with two other series elements in parallel for each bank. The oven is made up of six banks, and if that is drawn out as a typical three-phase diagram, it would be found that there are two delta configurations of twelve rods per delta, four rods per bank, and in each case the solid state relay is in series with each bank of the rods.

Because they are parallel delta configurations 1-SSR and 4-SSR are essentially operated at the same time along with 2-SSR and 5-SSR; and then 3-SSR and 6-SSR. They are all the corresponding parts one delta versus another.

The power supply 62 is simple 120 volt ac 50–60 hertz input supplying a high enough voltage rectified via CR-2 and CR-3 and filtered through C-1 to allow the 5 volt 1 amp integrated circuit voltage regulator No. 15 to supply 5 volt power for the operation of the process controller.

Figure 6A:
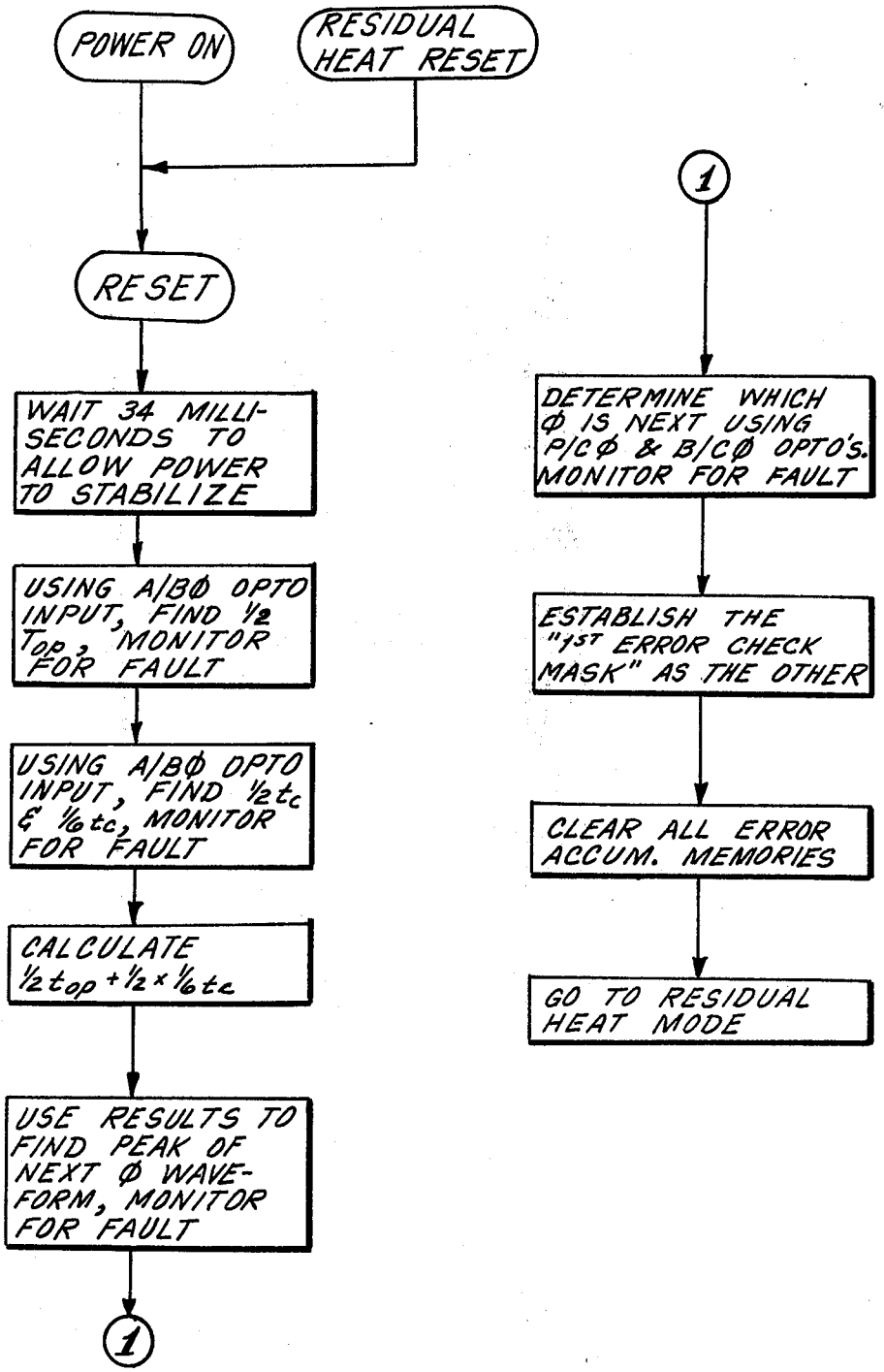
FIG. 6 is a computer flow chart of the microcomputer employed in FIG. 5.
Figure 6B:
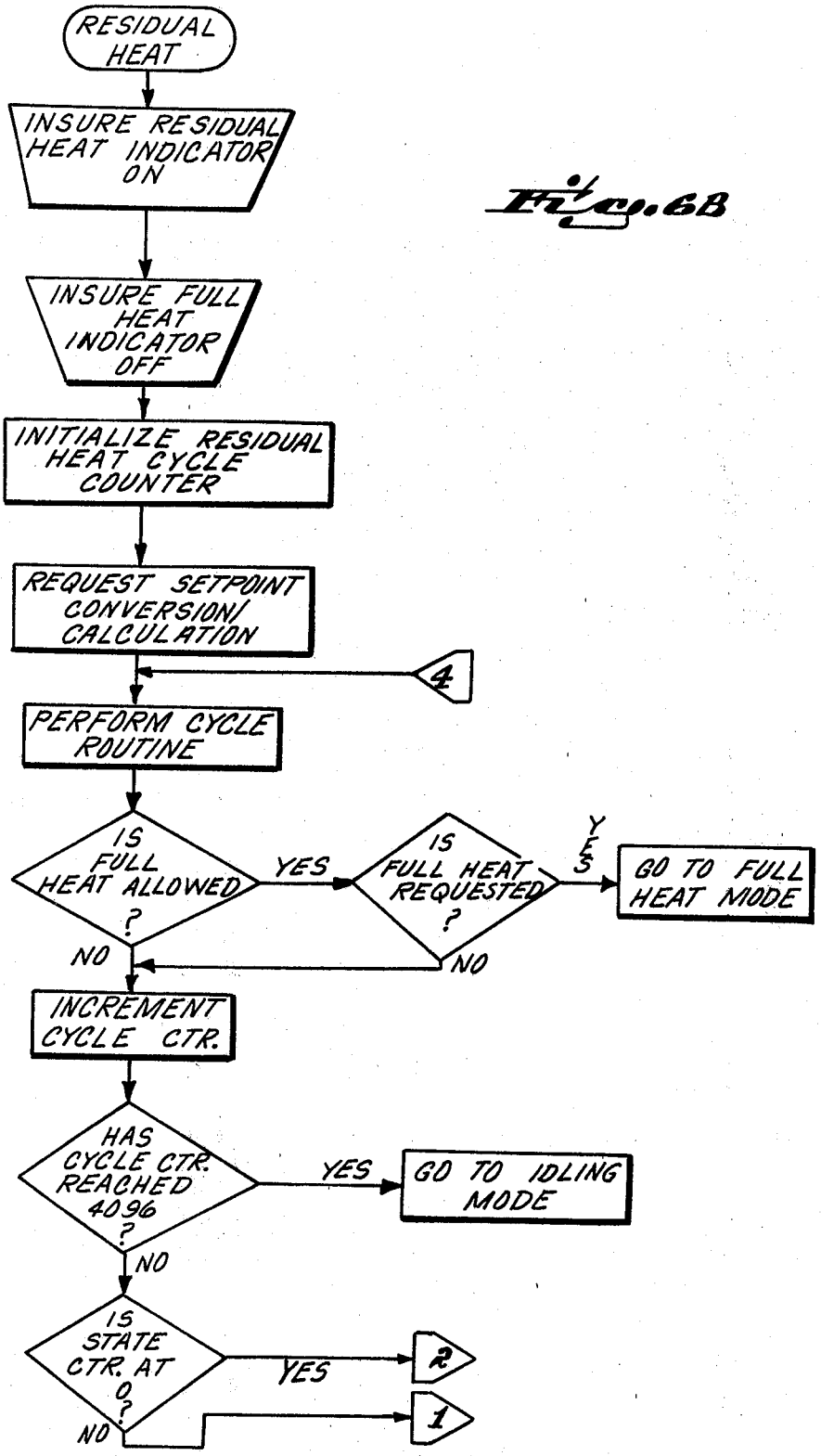
Figure 6C:
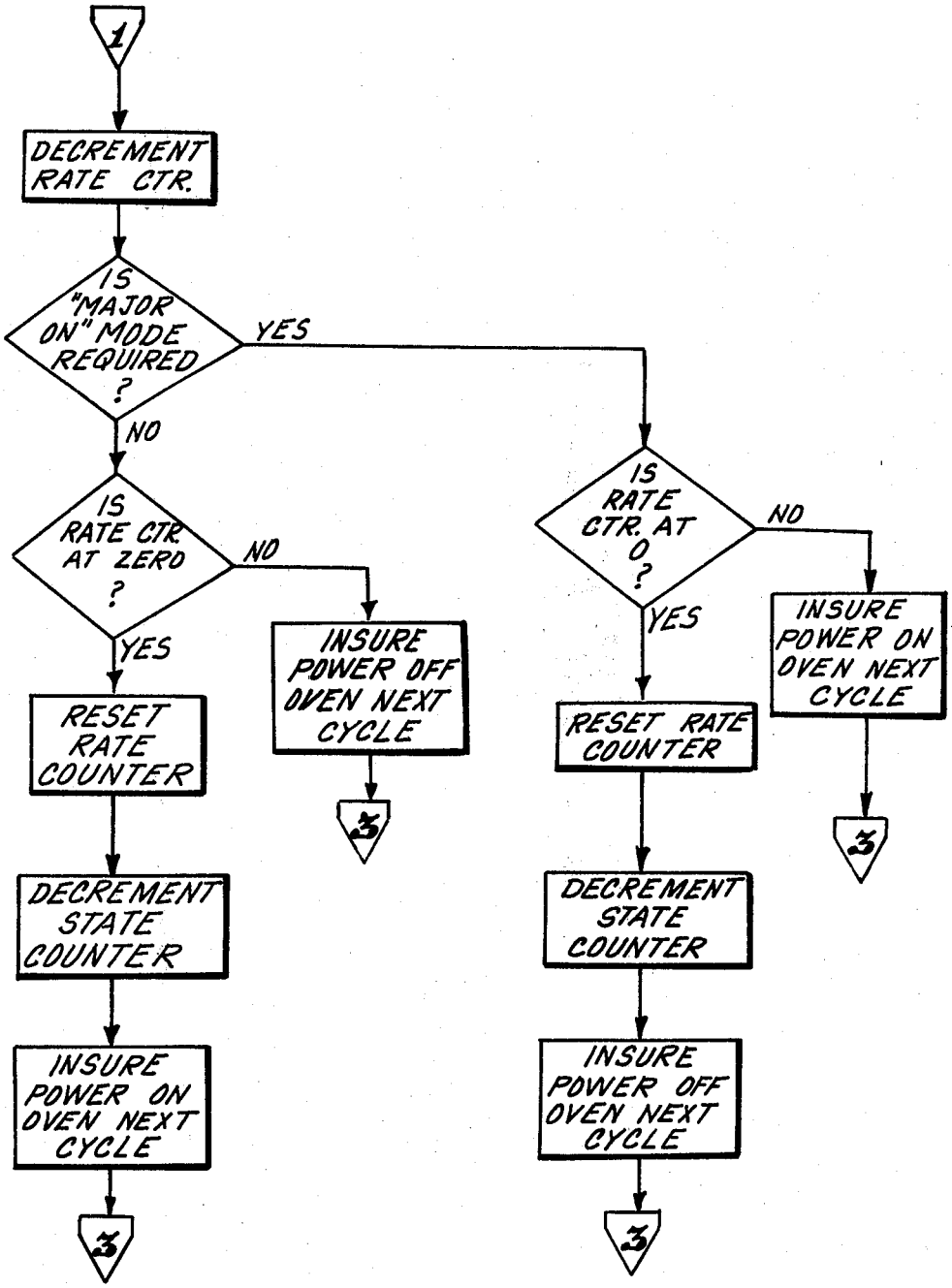
Figure 6D:
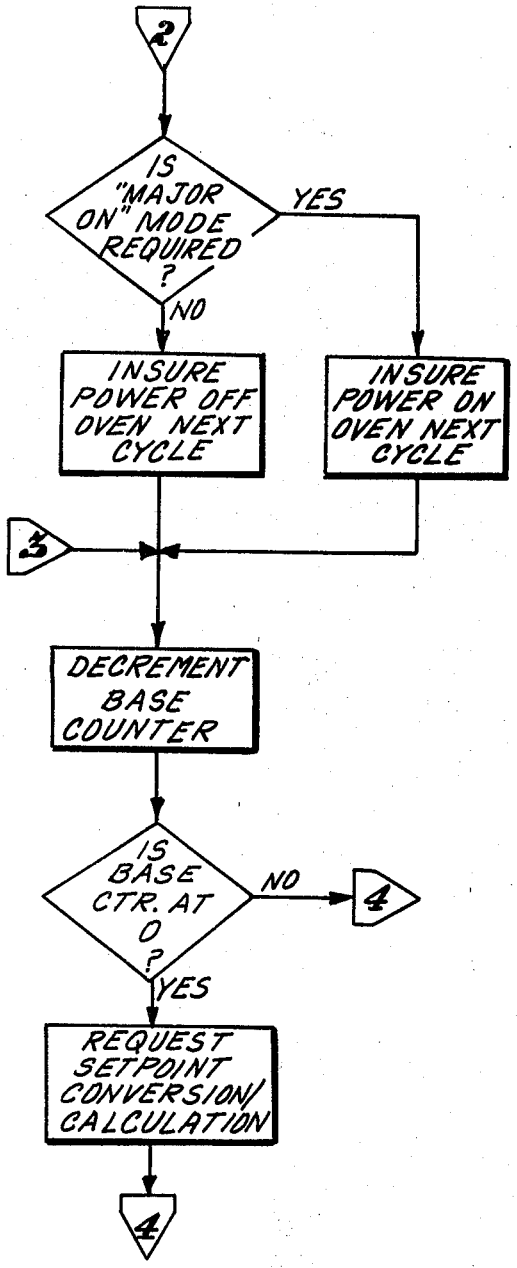
Figure 6E:
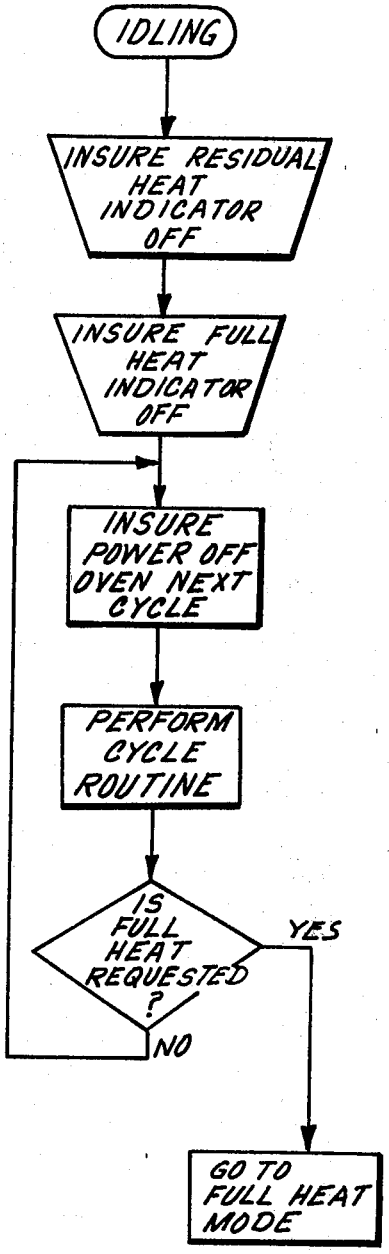
Figure 6F:
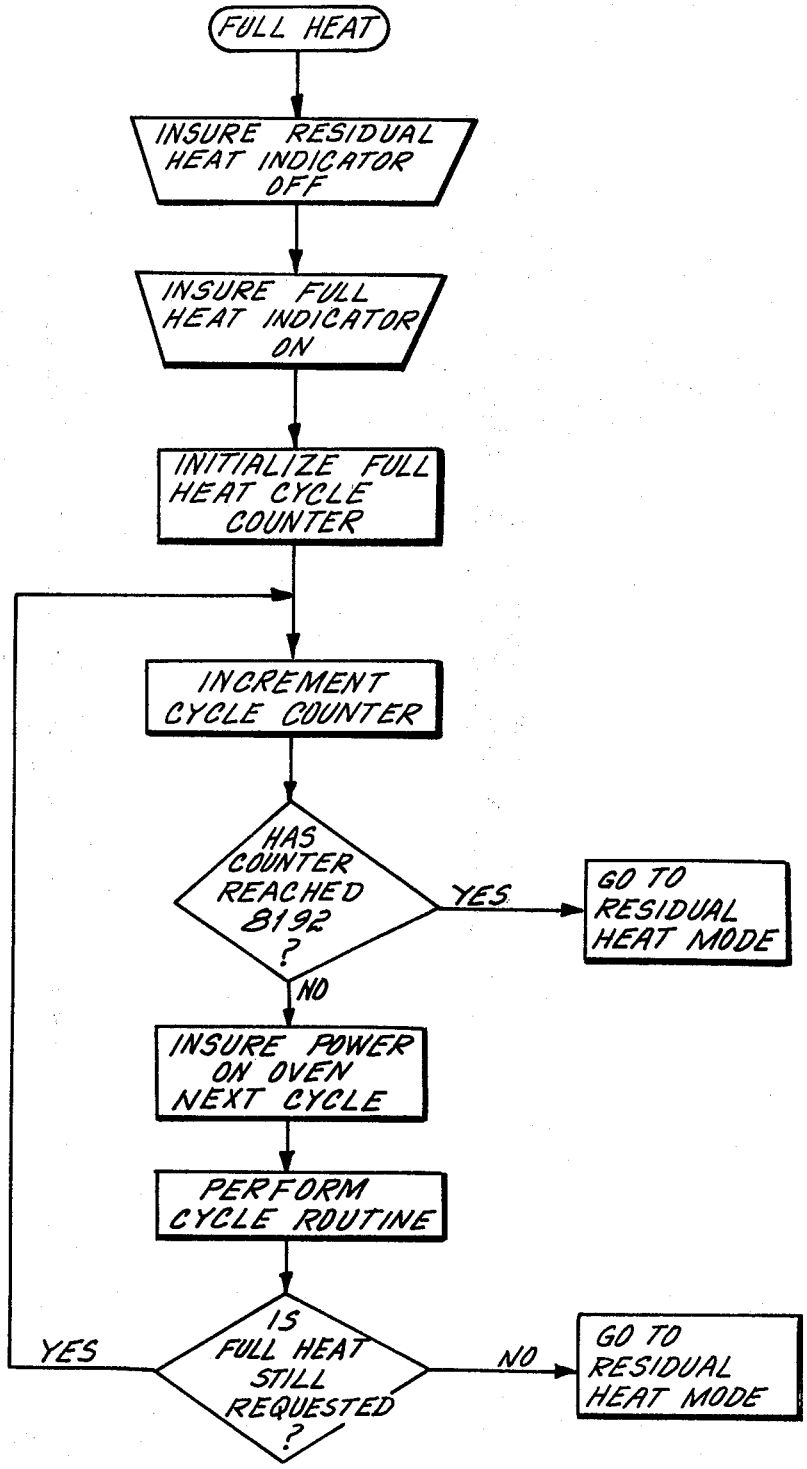
Figure 6G:
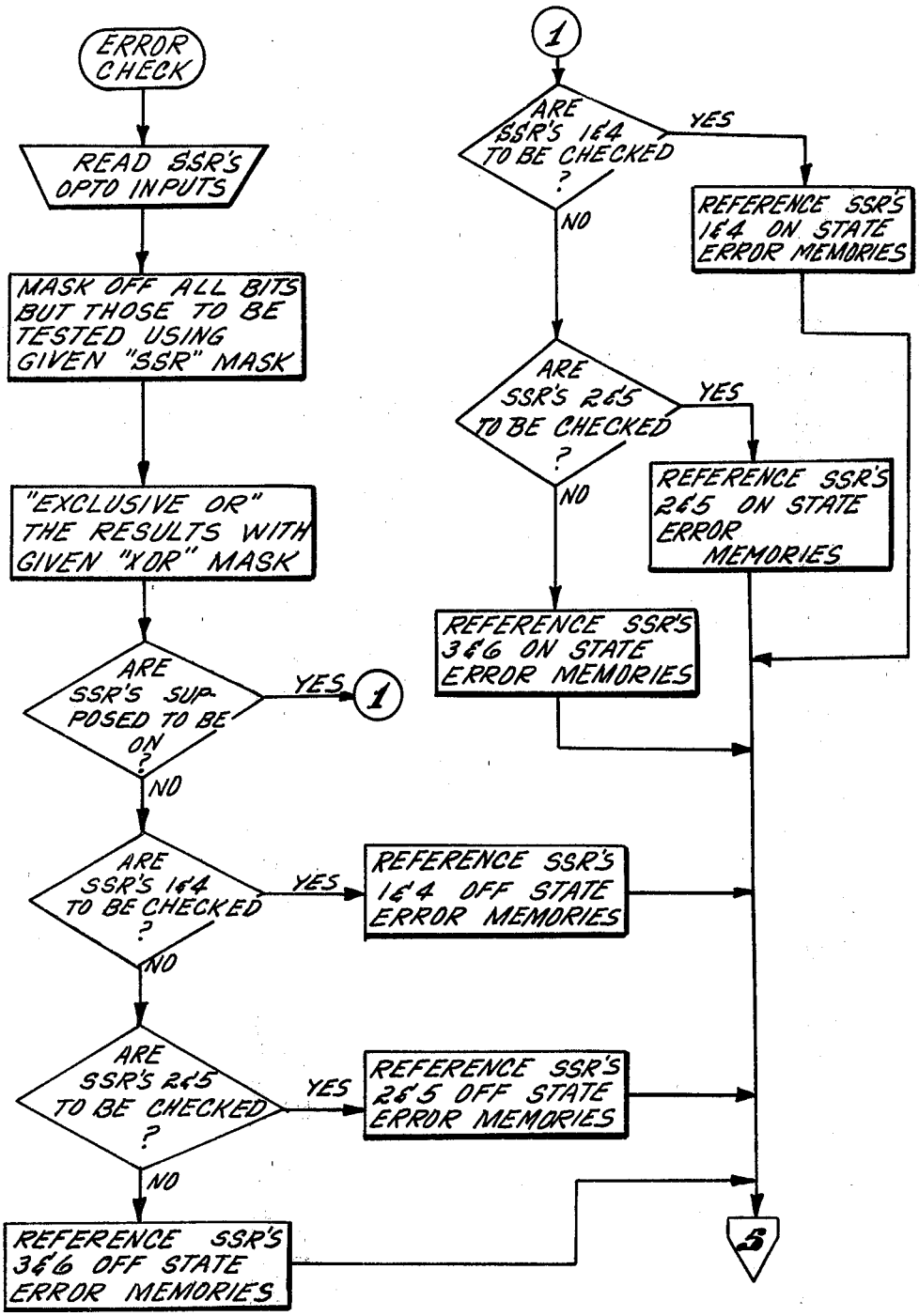
Figure 6H:
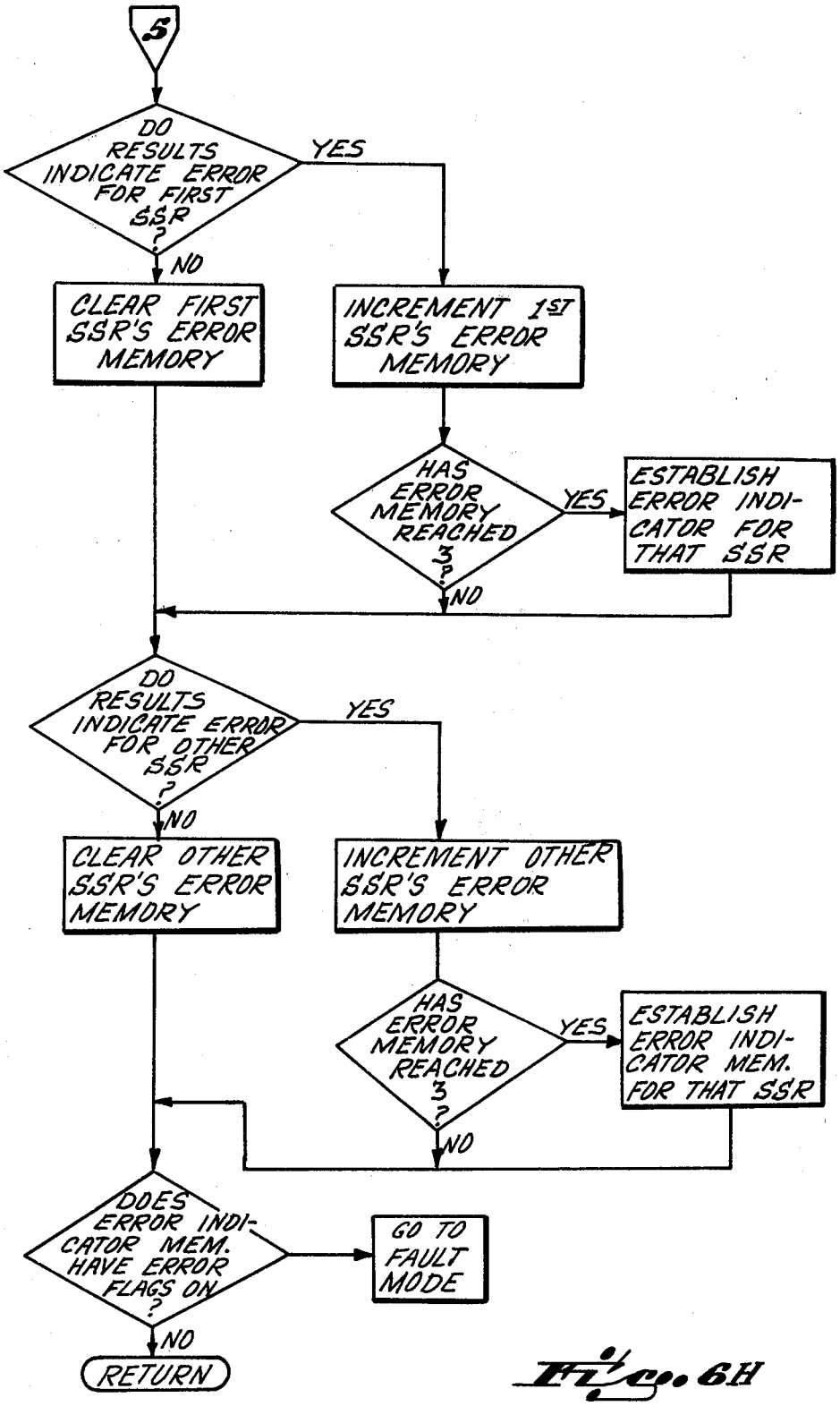
Figure 6I:
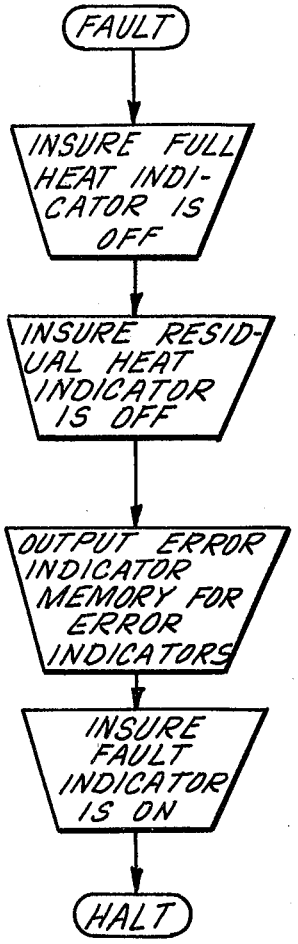
Figure 6J:
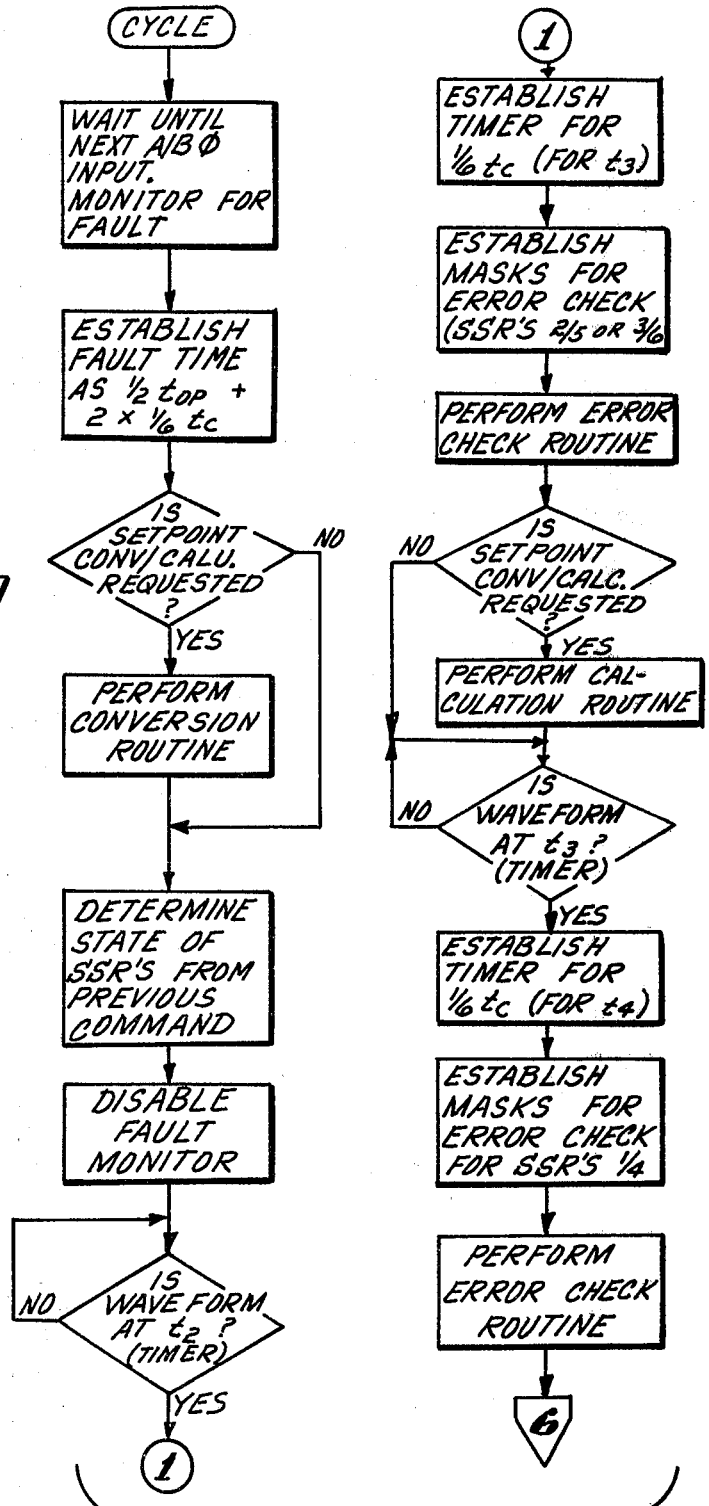
Figure 6K:
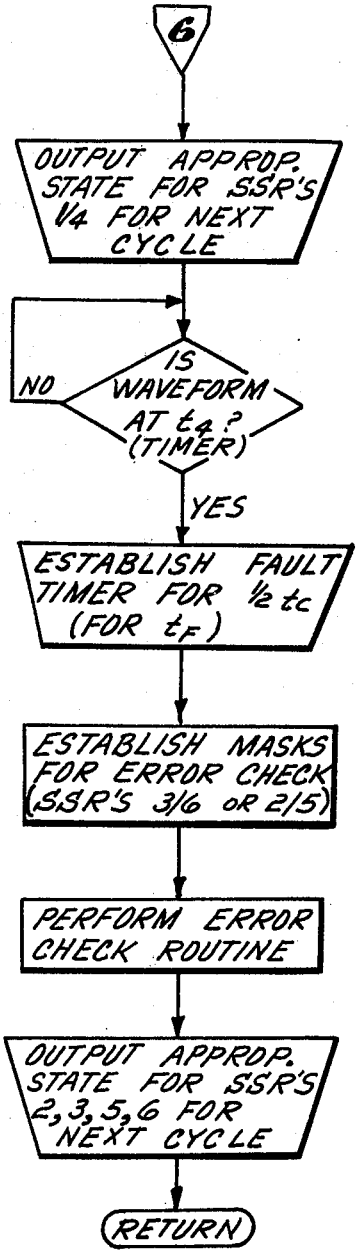
Figure 6L:
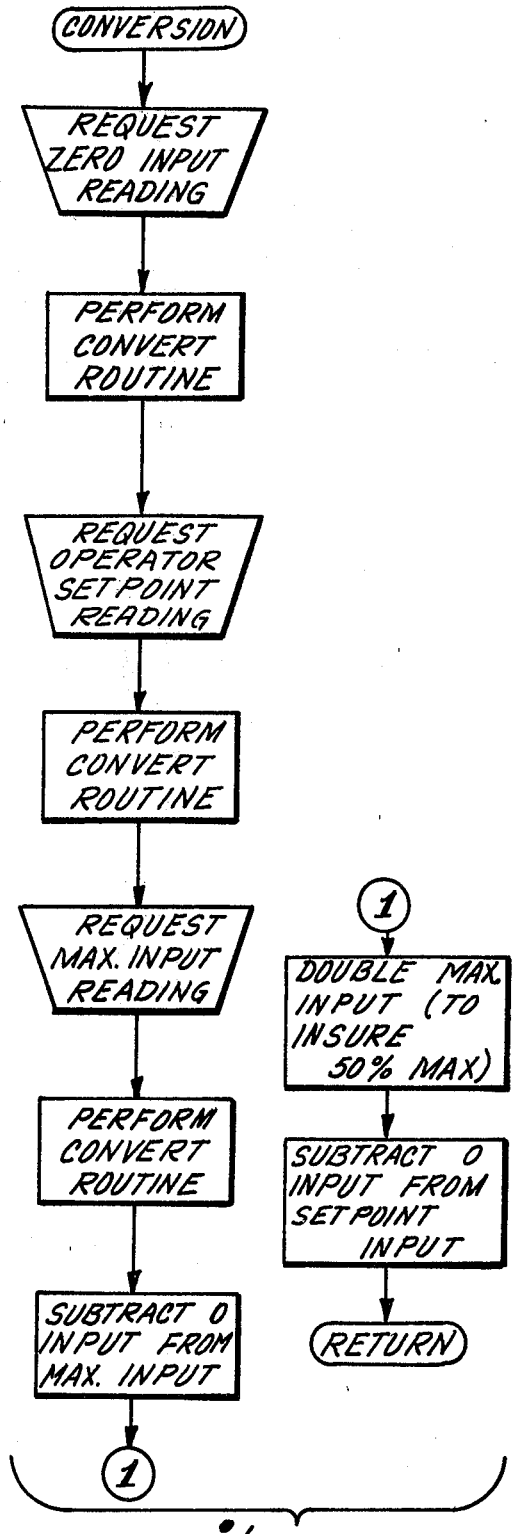
Figure 6M:
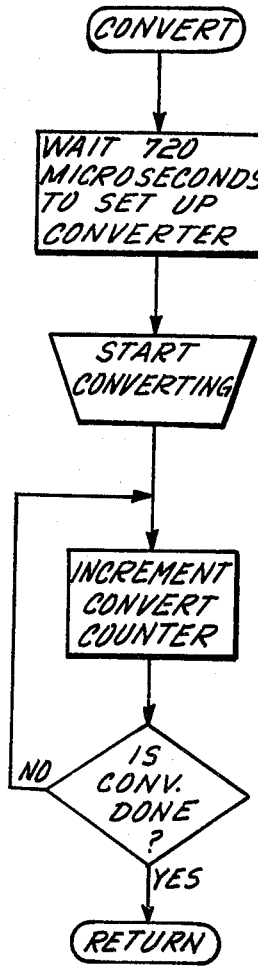
Figure 6N:
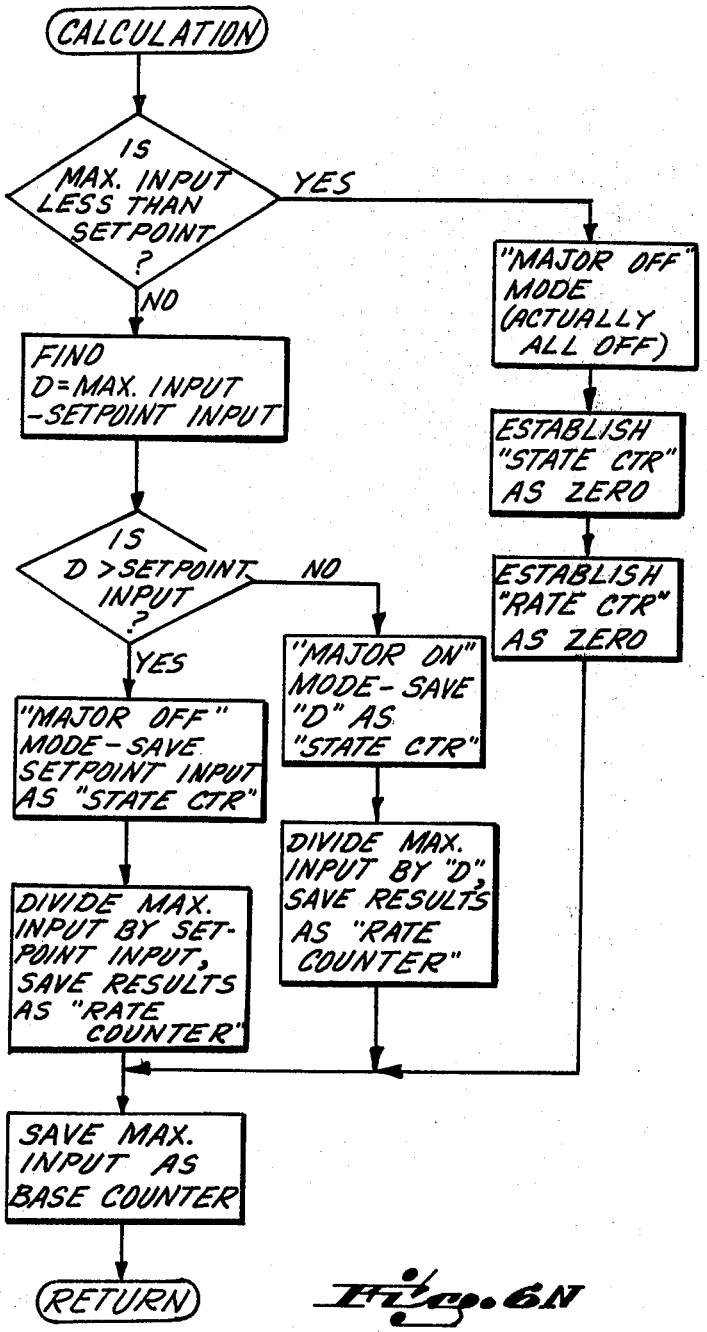
Figure 1:
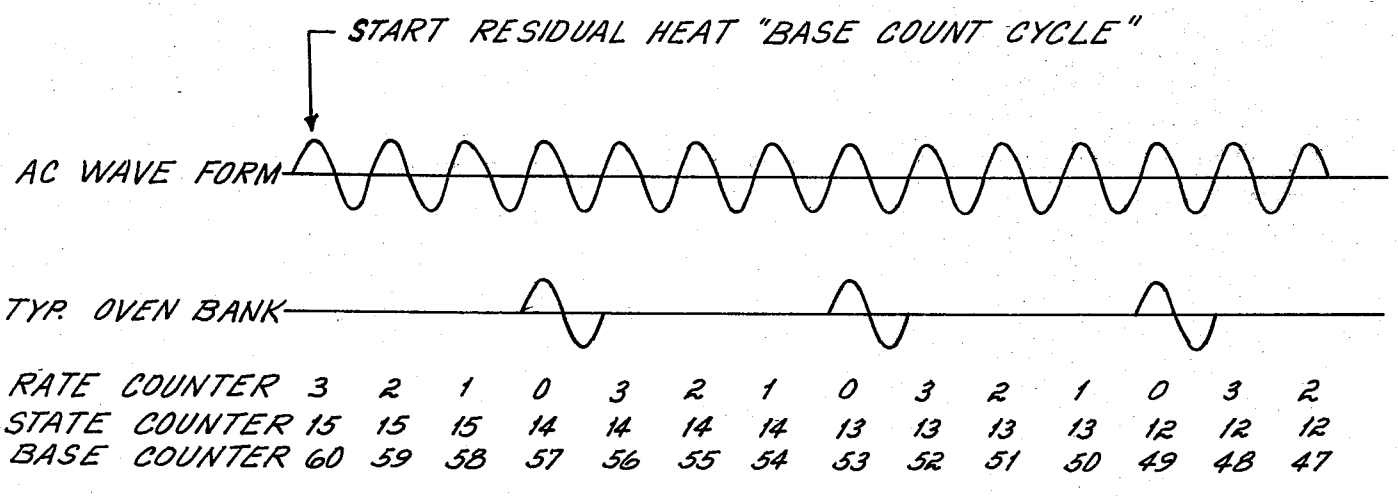

The flow chart of FIG. 6A to 6N describes in a general manner all of the functions of the operating program.

In FIG. 6A, power-on and residual heat reset are both feeding reset. The characteristic of the reset is built into the processor by Intel. When the power comes on, if the reset input to the processor is at logical 0, then the controller will automatically start at location 0 and at location 0 in the program the reset routine is to be jumped to. The concept here is that if you turn either the power on or if you hit the reset button of the machine to provide the reset residual heat input with a signal, you will command that operation.

The basic function of the reset routine is to establish the system timing and to initialize the error memories and to insure that the power is available on all three phases. There is some description here about monitor for fault on these. If it did not get the entire information within a certain period of time, then the machine goes into a fault mode. The maximum period of time can be, with 3.58 megahertz crystal on this unit, 34 milliseconds, which is what we call one entire count from 0 to 256 of the internal timer of the microcomputer 50.

In FIG. 6B through 6D is described the basic loop of the residual heat mode. The residual heat is the first of the three primary modes of operation. Residual or low heat counts the number of cycles that is performing through, and once it has counted up to 4096 cycles, which is approximately one minute, eight seconds, it will jump into the idling mode. If a full-heat request is made by the machine to the full-on input during the residual heat, then it will jump into the full-heat mode. The idling mode and the full-heat mode are the other two major modes of operation.

The residual heat routines uses three counters to perform its task. The three counters are the rate counter, the state counter and the base counter. The information given by these three counters determines the switching characteristics for the whole collection of waveforms to achieve the desired residual heat percentage. The rate counter is the amount of cycles that will be allowed to go by before a change of state is commanded by the residual heat routine for the SSR's. At the last count of the rate counter, the SSR's will be, for one cycle, the other state. This residual heat routine switching system is designed to operate from 0 to 100%, but the calculation system routine is limited only to fifty percent. So essentially, the major ON mode program will never be operated—only the major OFF mode which is shown in the vertical column in FIG. 6-C to the left as opposed to the columns to the right.

The rate counter will therefore, in the major OFF mode, run the first set of cycles as it is counting down OFF, and when it gets to 0 it will set one cycle ON. That means that the solid state relays will all be On for one cycle and then they will all be OFF again. At that time, the rate counter is reset and allowed to count down again. As soon as the total number of ON cycles has met the quantity of the state counter, then the cycles are no longer allowed to turn ON until the base counter has totally counted out. The base counter counts every single cycle. There is a diagram accompanying the flow chart (FIG. 7) which describes these features in greater detail.

The idling routine in FIG. 6E is very self-explanatory. It just states the fact that residual heat light must not be ON. Your full-heat light must not be ON. You oven must not be ON. And then it just tests to see if the full-heat request is made. If it is not, it just keeps waiting. Full-heat in FIG. 6F of course is the opposite of the no-heat during idling. It makes sure that the residual-heat light is OFF, the full-heat light is ON and that the oven is full-ON, but it also counts the number of cycles that it has been running. And if it ever receives the count of 8192 which is approximately two minutes, sixteen seconds, then it reverts to the residual-heat mode. It is to try to keep the machine from overheating if something went wrong and for some reason an operator was not attending it at that moment. It will keep flopping between two minutes and sixteen seconds in full heat, and one minute, eight seconds in residual heat until someone stops it.

All of these modes refer to a cycle routine. The cycle routine will be described later.

The next item is the error check of FIG. 6G and FIG. 6H. The whole function of the error check is to: pick up information given by the cycle routine as to which solid state relays are to be checked; determine whether or not they are at the proper state; determine whether or not they have been at that proper state; determine whether they have missed that proper state three times. If they have not missed the proper state at all, the error memories which are being maintained on every one of the solid state relays for ON state and OFF state are set to 0 for the appropriate state. If they have missed three proper states, the information is given into a special error fault memory which is checked at the end of the error routine, and if the error fault memory does have an error fault in it, the error automatically jumps into the fault mode which stops everything.

The fault mode of FIG. 6I of course insures all the indicator lights are off except the fault indicator. Then it lights the appropriate solid state relay error indicators if there are any. The fault routine is also the routine that is acted upon by what is referred to as the fault timer during monitor for fault. What it means is that when the controller is seeking one of the power inputs, the AB-phase opto or the BC-phase opto or the AC-phase opto, and it does not encounter them, it is not checking a solid state relay, which means that one would not get any error light for a solid state relay, but it did not find what it needed to in terms of the main power. So this fault routine is automatically called if the time has expired that it is allowed to look for it.

Moving into the cycle routine in FIG. 6J and FIG. 6K, the cycle routine operates with the concept of checking the peaks of the waveforms at the appropriate times to determine whether or not the solid state relays are either ON or OFF at the appropriate times, and to set them for the next cycle when they must be set. They cannot all be set out at once because it would not be a smooth operation. They have to be set sequentially, that is, solid state relays number 1 and 3 must be set first because the system is keying off the A-phase, B-phase for the beginning of each cycle, and solid state relays 2, 3, 5 and 6 are set on at the end of the cycle routine. This is based on the concept that the solid state relays will change state if the input state is modified 5° before the 0 crossover line of the ac waveform.

The timing of the cycle routine is best viewed on the waveform chart of FIG. 8.

Moving on to the conversion function (FIG. 6L and FIG. 6M) which converts the operator set point potentiometer reading into digital information for the switching characteristic requirement of the residual-heat mode program, the flow chart describes the internal timing and counting functions of the processor, as was mentioned earlier, to do a radiometric conversion which is merely a relative conversion, "relative" being comparing the set point of the potentiometer against what its maximum reading could be.

The calculation routine (FIG. 6N) determines the quantities required for the rate counter, the state counter and the base counter based on the maximum input and the set point inputs.

I claim:

1. Apparatus for skin packaging comprising:

a base including a horizontal perforate surface adapted to receive a substrate and at least one article on said substrate, an oven overlying said perforate surface, said oven including at least one heater, a frame disposed between said oven and said perforate surface and adapted to receive a film to be heated by said oven and mounted on a substrate, an alternating current power supply connected to said heater, at least one solid state relay in series with said heater, means for controlling said relay to provide a period of low heat and a period of high heat, said controlling means providing a low heat duty cycle of less than approximately one second, during one portion of said duty cycle power to said heater is full ON and during the remaining portion of said duty cycle power is full OFF.

2. Apparatus as in claim 1 further comprising means forming part of said controlling means for varying length of time during said duty cycle wherein said power is full OFF, thereby varying the average power to the heater during the low-heat period.

3. Apparatus as in claim 1 wherein said controlling means further comprises, means for switching power to said heater to full ON during one alternating current cycle and switching power to full OFF during at least one alternating current cycle, and means for varying the number of full OFF alternating current cycles, thereby varying the average power to said heater.

4. Apparatus as in claim 1 wherein said controlling means switches between full ON and full OFF at approximately the zero crossover of each alternating current cycle.

5. Apparatus as in claim 1 wherein said heater comprises at least one quartz tube having a nichrome ribbon heater element wound thereon.

6. Apparatus as in claim 1 further comprising means for switching to an idling mode after said period of low heat continues for at least approximately one minute.

said power supply applying no power to said heater during said idling mode.

7. Apparatus as in claim 1 in which said heater comprises a plurality of nichrome heater elements mounted on a quartz tube, said heater elements being connected in a delta configuration, said power supply being a three-phase alternating current supply.

8. Apparatus as in claim 1 further comprising a fan for blowing cool air over said film during the period of low heat, thereby permitting said oven heat to be maintained at a higher level during said low heat period without permitting said film to sag unduly.

* * * * *